US007770768B1

(12) United States Patent
Primos

(10) Patent No.: US 7,770,768 B1
(45) Date of Patent: Aug. 10, 2010

(54) ARCHERY BOW COVER AND SLING APPARATUS

(75) Inventor: Wilbur R. Primos, Madison, MS (US)

(73) Assignee: Primos, Inc., Flora, MS (US)

( * ) Notice: Subject to any disclaimer, the term of this patent is extended or adjusted under 35 U.S.C. 154(b) by 626 days.

(21) Appl. No.: 11/465,778

(22) Filed: Aug. 18, 2006

(51) Int. Cl.
*A45F 3/02* (2006.01)

(52) U.S. Cl. ..... 224/609; 224/607

(58) Field of Classification Search ..... 224/609–612, 224/242, 250, 257; 206/315.1, 315.11; 124/25.6, 124/86; D22/107
See application file for complete search history.

(56) References Cited

U.S. PATENT DOCUMENTS

| | | | | |
|---|---|---|---|---|
| 213,851 | A | | 4/1879 | Streeter |
| 1,781,816 | A | * | 11/1930 | Jovino ..... 224/223 |
| 2,968,300 | A | | 1/1961 | Allen |
| 3,055,354 | A | | 9/1962 | Gates |
| 3,058,505 | A | | 10/1962 | Emmett |
| 3,103,213 | A | | 9/1963 | Robinson |
| 3,168,971 | A | | 2/1965 | Goertzen |
| 3,204,626 | A | | 9/1965 | Morneau |
| 3,208,653 | A | | 9/1965 | Wallace |
| 3,232,501 | A | | 2/1966 | Merenda |
| 3,599,621 | A | | 8/1971 | Scrobell |
| 3,960,302 | A | | 6/1976 | Mazzoni, Jr. |
| 3,998,367 | A | | 12/1976 | Harding |
| 4,103,807 | A | * | 8/1978 | Lyon et al. ..... 224/222 |
| 4,121,743 | A | | 10/1978 | Burton |
| 4,480,774 | A | | 11/1984 | Smith et al. |
| 4,621,752 | A | | 11/1986 | Youngbauer |
| 4,674,472 | A | | 6/1987 | Reis |
| 4,684,047 | A | | 8/1987 | Burgwin |
| 4,714,071 | A | | 12/1987 | Saunders |
| 4,754,904 | A | | 7/1988 | Fischer et al. |
| 4,760,944 | A | | 8/1988 | Hughes |
| 4,768,689 | A | | 9/1988 | Davis |
| 4,777,666 | A | | 10/1988 | Beverlin |
| 4,785,934 | A | | 11/1988 | Hogle |
| 4,790,300 | A | | 12/1988 | Marx |
| D300,989 | S | | 5/1989 | Kovach |
| 4,836,177 | A | | 6/1989 | Williams |
| 4,877,007 | A | | 10/1989 | Olson |
| 4,911,136 | A | | 3/1990 | Brown |
| 5,038,987 | A | | 8/1991 | Huddleston |
| 5,063,678 | A | | 11/1991 | Simo |

(Continued)

OTHER PUBLICATIONS

Photographs of bow sling made by VISTA.

*Primary Examiner*—Nathan J Newhouse
*Assistant Examiner*—Corey N Skurdal
(74) *Attorney, Agent, or Firm*—Holland & Hart

(57) ABSTRACT

An archery bow cover and sling apparatus is disclosed comprising a cover structure comprising a string enclosing portion, a first end enclosing portion provided on a first end of the string enclosing portion, and a second end enclosing portion provided on a second opposing end of the string enclosing portion, a strap assembly attached to the cover structure, and a first bow retention assembly provided proximate the first end enclosing portion and configured to retain at least a portion of an archery bow within the first end enclosing portion. The string enclosing portion may comprise at least one fastener assembly configured to removably secure the string enclosing portion around at least a bowstring of the archery bow. A corresponding method of manufacturing is also disclosed.

10 Claims, 5 Drawing Sheets

U.S. PATENT DOCUMENTS 5,065,732 A 11/1991 Smith
5,165,584 A 11/1992 Meagher et al.
5,205,268 A 4/1993 Savage
5,239,976 A 8/1993 Specht
5,246,154 A 9/1993 Adams et al.
5,297,533 A 3/1994 Cook
5,351,867 A 10/1994 Vest
D354,393 S 1/1995 Mocca
5,465,887 A 11/1995 Hudson
5,482,241 A 1/1996 Oglesby
5,487,374 A 1/1996 Herminath et al.
5,499,752 A 3/1996 Johnson
5,513,621 A 5/1996 Vanskiver
5,522,376 A 6/1996 Collinsworth
5,607,091 A * 3/1997 Musacchia ..... 224/222
5,617,838 A 4/1997 Peruski
5,630,568 A 5/1997 Lubrecht
5,655,803 A 8/1997 Tacoronte
5,664,721 A 9/1997 Homeyer
5,669,170 A 9/1997 Norris
5,697,537 A 12/1997 Bowlsby
5,711,467 A 1/1998 Brown, Sr.
5,730,341 A 3/1998 Hester
5,738,080 A 4/1998 Brocco, Jr.
5,775,314 A 7/1998 Michael et al.
5,816,461 A 10/1998 Balcom
5,832,910 A 11/1998 Wolfrath et al.
5,832,912 A 11/1998 Olivarez
5,850,955 A 12/1998 Barr
5,857,651 A 1/1999 Kunevicius
5,890,478 A 4/1999 Dunmore
5,975,389 A 11/1999 Braun et al.
D425,959 S 5/2000 Gibbs
6,119,907 A 9/2000 Benjamin
6,155,470 A 12/2000 Robison
6,173,706 B1 1/2001 McConnell
6,216,933 B1 * 4/2001 Healy ..... 224/663
6,267,278 B1 7/2001 Bogart
6,290,114 B1 9/2001 Berberian
6,419,097 B1 7/2002 Anderson
6,691,693 B1 2/2004 Trussell, II
D510,973 S 10/2005 Primos et al.
2003/0124270 A1 7/2003 Porter

* cited by examiner

ARCHERY BOW COVER AND SLING APPARATUS

FIELD OF THE INVENTION

The instant disclosure relates generally to the field of archery and, more particularly, archery bow covers and slings.

BACKGROUND

Over the years, various types and forms of covers and slings for archery bows have been developed. Some prior archery bow covers and slings have included an elongated and elastically tensioned cover member having closed ends that may be positioned about the ends of an archery bow. The cover member is typically elastically secured to the archery bow by inserting the end of a first end of the bow into a first closed end of the cover member, and then elastically stretching the cover member until a second opposing closed end of the cover member may be positioned about a second opposing end of the bow. A strap or sling may also be attached to the cover member to allow a user to conveniently carry the cover member, and the archery bow retained within the cover member, by draping the strap over the user's shoulder or arm.

Although conventional archery bow covers and slings are convenient for transporting and protecting archery bows, recent modifications to compound archery bows have reduced the effectiveness of conventional archery bow covers and slings. For example, certain modern compound archery bows now comprise limbs that are positioned substantially parallel to one another, as opposed to limbs that extend opposite and away from each other in a more vertical alignment with the handle riser. Thus, when a user attempts to secure a conventional bow cover to a bow having substantially parallel limbs, the substantially parallel limbs of the bow must be inserted into the closed ends of the cover member at a substantially perpendicular angle, as opposed to being in substantial parallel alignment with the cover member. This configuration, however, may allow the cover member to slide off of the ends of the parallel limbs and cams of the archery bow, and may permit the archery bow to fall out of the cover and sling. Accordingly, there is a need for an improved archery bow cover and sling apparatus.

SUMMARY

According to at least one embodiment, an archery bow cover and sling apparatus comprises a cover structure comprising a string enclosing portion, a first end enclosing portion provided on a first end of the string enclosing portion, and a second end enclosing portion provided on a second opposing end of the string enclosing portion, a strap assembly attached to the cover structure, and a first bow retention assembly provided proximate the first cam enclosing portion and configured to retain at least a portion of an archery bow within the first cam enclosing portion. In certain embodiments, the archery bow cover and sling apparatus may also comprise a second bow retention assembly provided proximate the second end enclosing portion and configured to retain at least a portion of the archery bow within the second end enclosing portion. In addition, the string enclosing portion may comprise an elastomeric member configured to create elastic tension between the first cam enclosing portion and the second cam enclosing portion.

In some embodiments, the string enclosing portion may comprise at least one fastener assembly configured to removably secure the string enclosing portion around at least a bowstring of the archery bow. In at least one embodiment, this at least one fastener assembly may comprise a female snap-fit button and a male snap-fit button configured to removably snap fit into the female snap-fit button. In addition, the first bow retention assembly may comprise an anchor structure and an elastomeric cord configured to be removably secured to the anchor structure.

According to certain embodiments, the strap assembly may comprise a primary strap and at least one secondary strap wrapped around and affixed to at least a portion of the first cam enclosing portion. The cover and sling apparatus may also comprise at least one strap retention member configured to retain the at least one secondary strap in a preferred position. At least one tab may also be provided proximate the first cam enclosing portion to provide a convenient and easily graspable structure for a user to grasp and pull when manipulating the elastomeric cord.

In at least one embodiment, a method of manufacturing an archery bow cover and sling apparatus comprises providing a cover structure comprising a string enclosing portion, a first end enclosing portion, and a second end enclosing portion, attaching a strap assembly to the cover structure, and attaching a first bow retention assembly proximate the first cam enclosing portion. In many embodiments, the first bow retention assembly may be configured to retain at least a portion of an archery bow within the first end enclosing portion. The method may also comprise attaching a second bow retention assembly proximate the second end enclosing portion, with the second bow retention assembly configured to retain at least a portion of the archery bow within the second end enclosing portion. In addition, the method may further comprise attaching at least one fastener assembly to the string enclosing portion, with the at least one fastener assembly configured to removably secure the string enclosing portion around at least a bowstring of the archery bow.

According to certain embodiments, a cover and sling apparatus for an archery bow having substantially parallel limbs comprises a cover structure comprising a string enclosing portion, a first end enclosing portion provided on a first end of the string enclosing portion, and a second end enclosing portion provided on a second, opposing end of the string enclosing portion, a strap assembly attached to the cover structure, with the strap assembly comprising a primary strap and at least one secondary strap wrapped around and affixed to at least a portion of the first end enclosing portion, an anchor structure affixed to a first side of the first end enclosing portion, and an elastomeric cord affixed to a second opposing side of the first end enclosing portion and configured to be removably secured to the anchor structure. In many embodiments, the elastomeric cord may be configured to wrap around at least a portion of the archery bow to retain the archery bow within the first cam enclosing portion.

Features from any of the above-mentioned embodiments may be used in combination with one another in accordance with the general principles described herein. These and other embodiments, features and advantages will be more fully understood upon reading the following detailed description in conjunction with the accompanying drawings and claims.

BRIEF DESCRIPTION OF THE DRAWINGS

The accompanying drawings illustrate a number of exemplary embodiments and are a part of the specification. Together with the following description, these drawings demonstrate and explain various principles of the instant disclosure.

Figure 1:
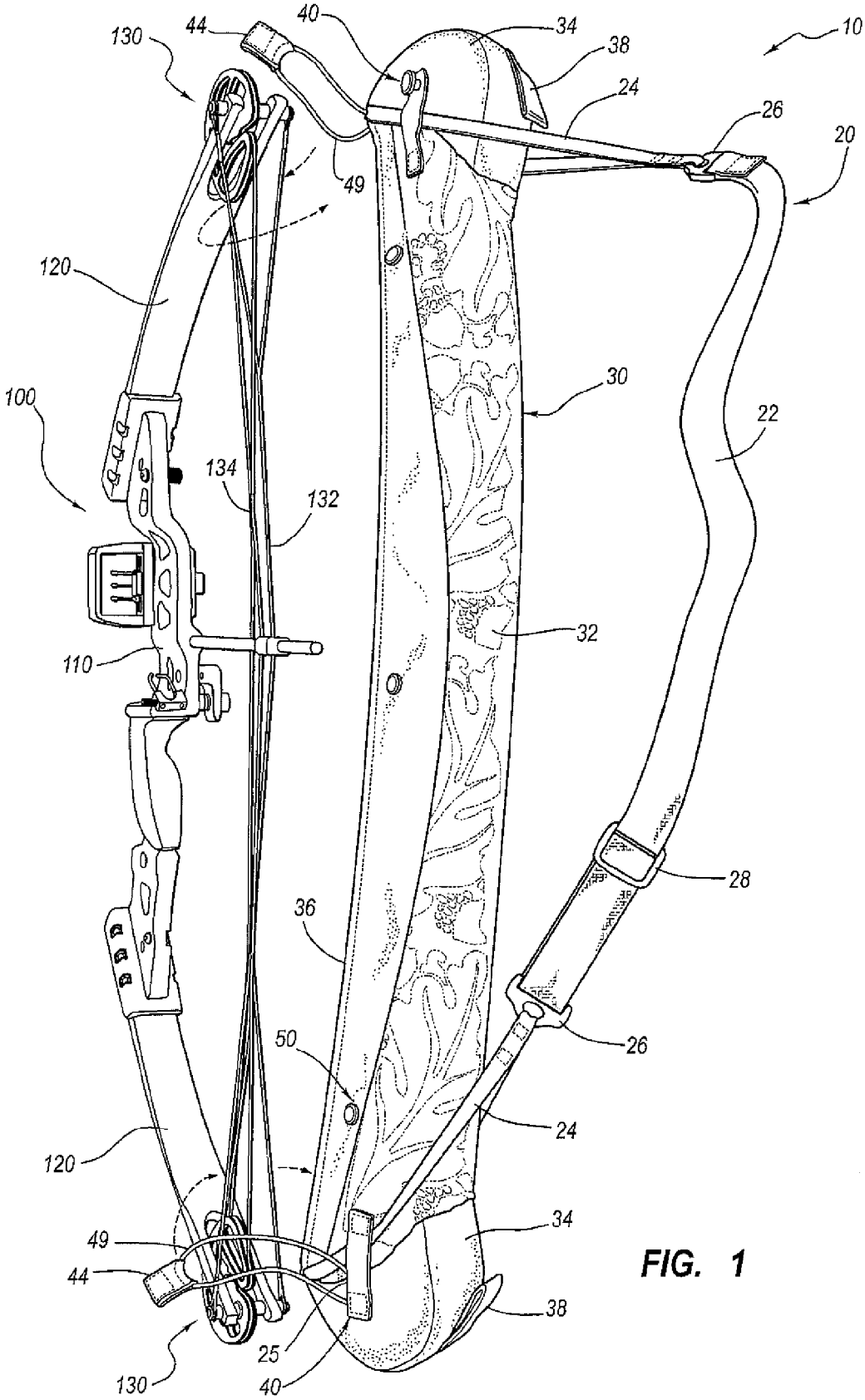
FIG. 1 is a perspective view of an exemplary archery bow and an exemplary bow cover and sling apparatus according to at least one embodiment.

Throughout the drawings, identical reference characters and descriptions indicate similar, but not necessarily identical, elements. While the exemplary embodiments described herein are susceptible to various modifications and alternative forms, specific embodiments have been shown by way of example in the drawings and will be described in detail herein. However, one of skill in the art will understand that the exemplary embodiments described herein are not intended to be limited to the particular forms disclosed. Rather, the instant disclosure covers all modifications, equivalents, and alternatives falling within the scope defined by the appended claims.

DETAILED DESCRIPTION OF EXEMPLARY EMBODIMENTS

FIGS. 1-6 are perspective views of an exemplary archery bow cover and sling apparatus 10 according to at least one embodiment. As seen in these figures, cover and sling apparatus 10 may comprise a strap assembly 20 attached to a cover structure 30. Cover structure 30 generally represents any shape, size, or length of material, plain colored or camouflage, capable of at least partially surrounding or covering at least a portion of an archery bow, such as exemplary archery bow 100 illustrated in FIG. 1. Exemplary archery bow 100 generally represents any type or form of archery bow, including modern compound archery bows. As seen in FIG. 1, in certain embodiments exemplary archery bow 100 may comprise a handle riser 110, a pair of resilient limbs 120, and a pair of cams 130. Exemplary archery bow 100 may also comprise a bowstring 132 and a set of cables 134. In at least one embodiment, limbs 120 may be configured so as to be substantially parallel to one another.

Figure 2:
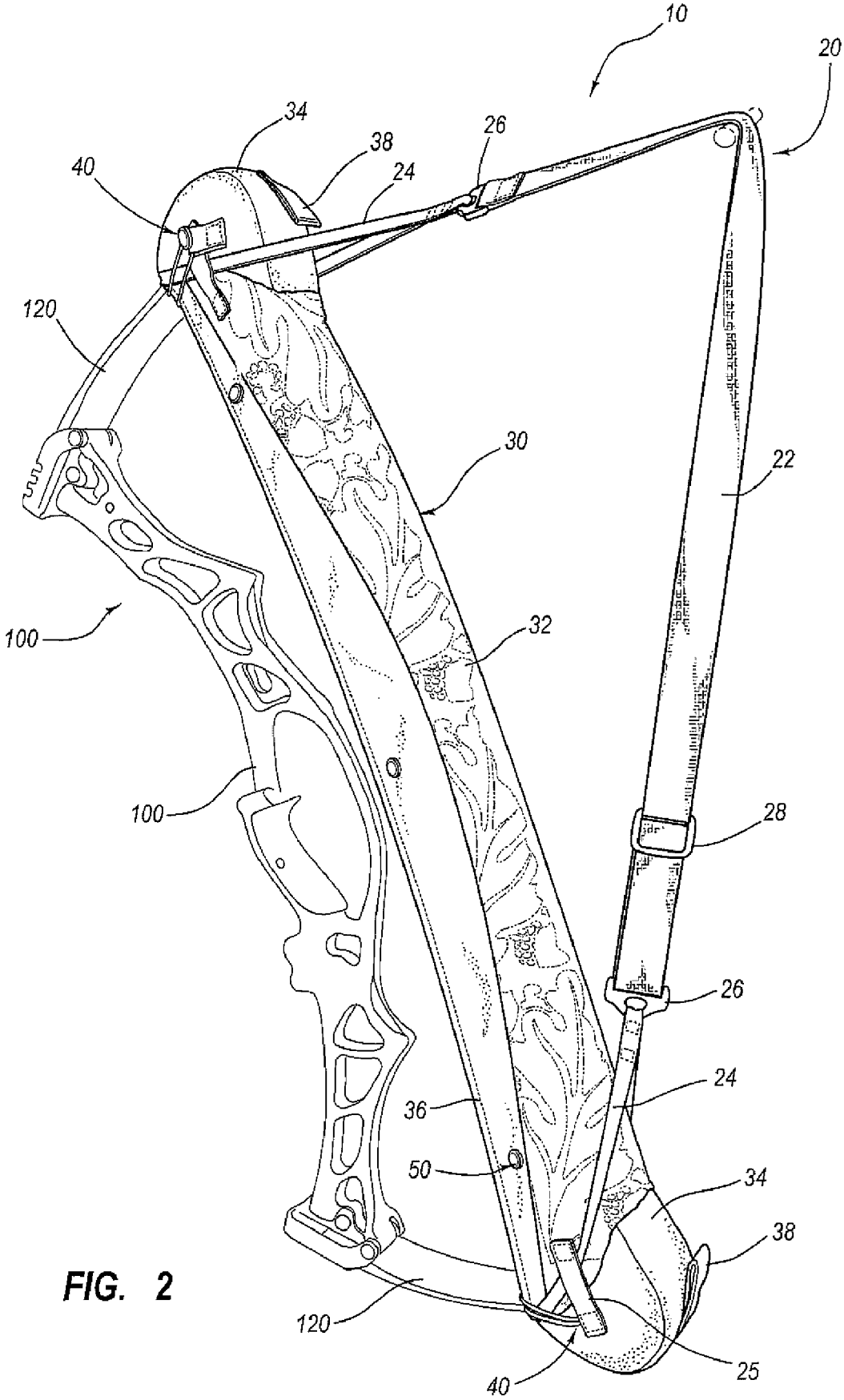
FIG. 2 is a perspective side view of the exemplary bow cover and sling apparatus illustrated in FIG. 1.

As seen in FIG. 2, cover structure 30 may comprise a string-enclosing portion 32, with each end of the string enclosing portion being secured to an end enclosing portion 34. In at least one embodiment, string enclosing portion 32 may be configured to receive and surround at least a portion of an archery bow, such as exemplary archery bow 100. For example, as seen in FIG. 2, string enclosing portion 32 may be configured to receive and surround at least a portion of bowstring 132 (FIG. 1) and/or cables 134 (FIG. 1) of exemplary archery bow 100. Similarly, in at least one embodiment end enclosing portions 34 may be configured to receive and surround at least a portion of an archery bow. An end of an archery bow may comprise a cam, a wheel, or any other end portion. For example, as illustrated in FIG. 2, end enclosing portions 34 may be shaped and sized to receive and surround at least an end portion of an archery bow (e.g., a cam, a wheel, or the like). FIG. 1 illustrates the string enclosing portion 32 having a first material (e.g., with a camouflage pattern) and the end enclosing portions 34 each having a second material.

In certain embodiments, string enclosing portion 32 may comprise an elastomeric member 36. As shown in FIG. 1, elastomeric member 36 generally represents any length or type of material capable of creating elastic tension between the opposing cam end enclosing portions 34. Elastomeric member 36 may be formed in any size or shape and of any number or combination of materials; including, for example, rubber or other suitable elastomers. Elastomeric member 36 may extend along or be positioned on at least one side of an opening into cover structure 30, and may extend along and be positioned on both sides of the opening into the cover structure 30 (see FIGS. 1-4). In at least one embodiment, cover structure 30 may be elastically secured to exemplary archery bow 100 by inserting a first end 130 (FIG. 1) of the archery bow 100 into a first end enclosing portion 34 of cover structure 30, and then elastically stretching elastomeric member 36 and cover structure 30 until a second opposing end enclosing portion 34 of cover structure 30 may be positioned about a second opposing end 130 of bow 100. In certain embodiments, one or more tabs 38 may be affixed to each end enclosing portion 34 to provide a convenient and easily graspable structure for a user to grasp and pull when manipulating cam enclosing portions 34 about cams 130 of exemplary bow apparatus 100.

Figure 3:
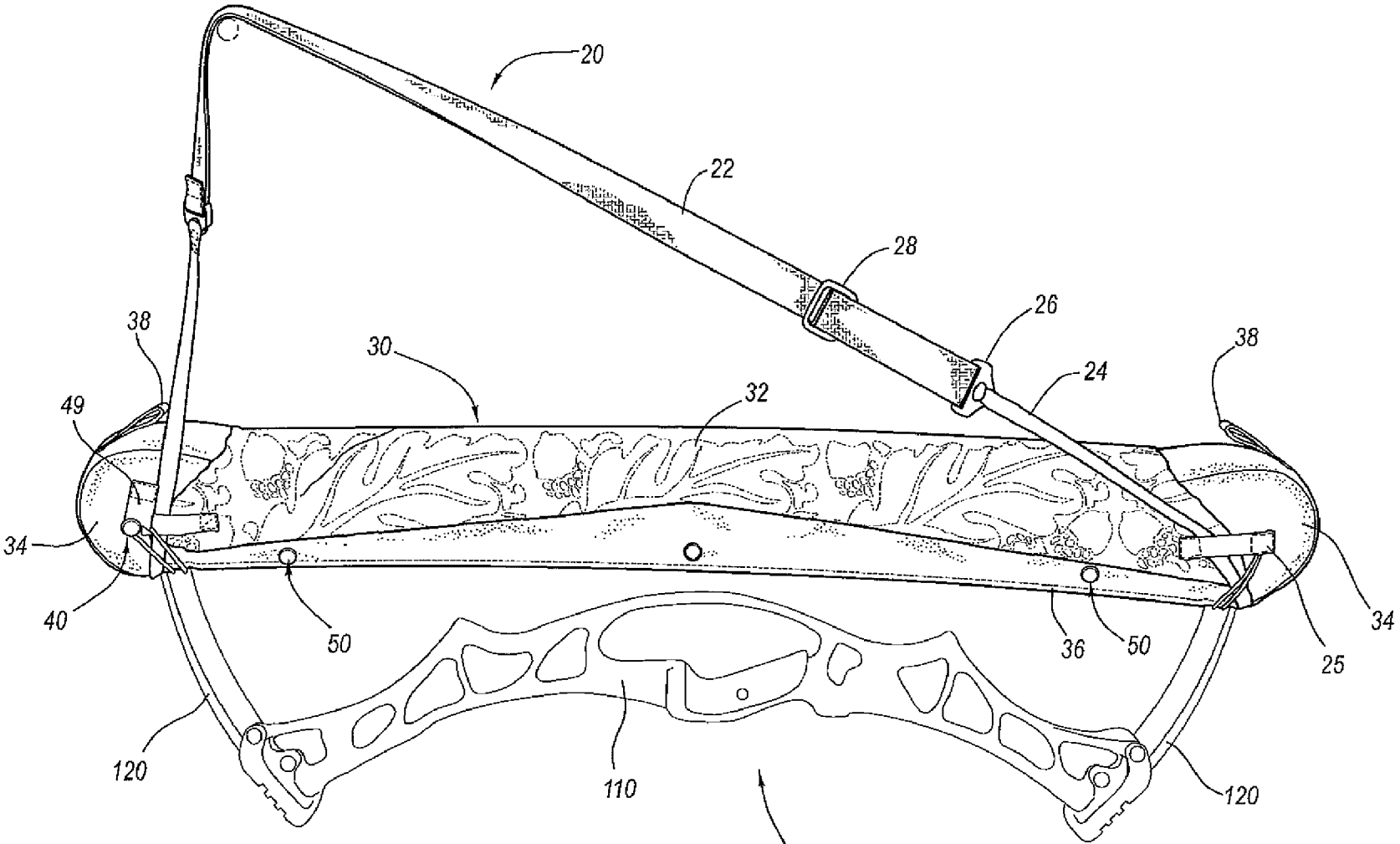
FIG. 3 is an additional perspective view of the exemplary bow cover and sling apparatus illustrated in FIG. 1.

As seen in FIGS. 2-3, string enclosing portion 32 may also comprise a fastener assembly 50. Fastener assembly 50 generally represents any suitable type of fastener or fastener assembly for removably securing string enclosing portion 32 around a portion of an archery bow, such as bowstring 132 and/or cables 134 of exemplary archery bow 100 (shown in FIG. 1). Examples of suitable fastener assemblies 50 include, without limitation, so-called snap-fit fastener assemblies, hook-and-loop fastener assemblies, button-type fastener assemblies, clasp-type fastener assemblies, toggle-type fastener assemblies, or the like. For example, as best seen in FIG. 4, fastener assembly 50 may comprise a male fastener 52 provided on a first side of string enclosing portion 32 and having a cantilevered portion configured to "snap fit" into a complimentary recess defined in a female fastener 54 provided on a second opposing side of string enclosing portion 32.

In certain embodiments, after positioning exemplary archery bow 100 within cover structure 30, the open sides of string enclosing portion 32 may be closed and fastener assembly 50 may be fastened to retain at least a portion of bow 100, such as bowstring 132 and/or cables 134, within string enclosing portion 32 of cover structure 30. In at least one embodiment, string enclosing structure 32 and fastener assembly 50 may protect the bowstring and/or cables of a bow, such as exemplary bow apparatus 100, from being damaged by external elements. For example, string enclosing portion 32 and fastener assembly 50 may prevent bowstring 132 and/or cables 134 of exemplary bow apparatus 100 from snagging on or being cut or otherwise damaged by rocks, trees, or similar external elements.

Figure 4:
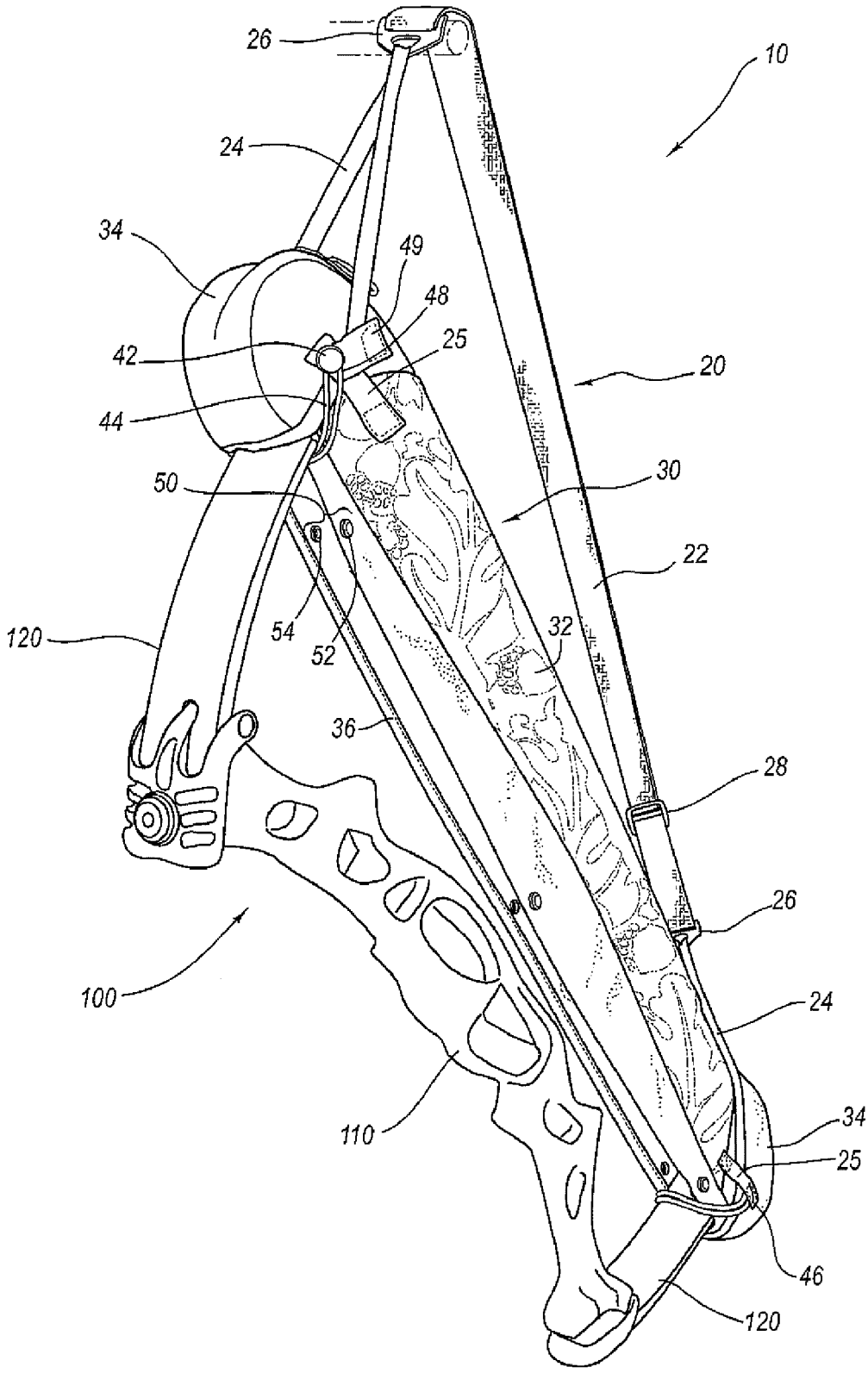
FIG. 4 is an additional perspective view of the exemplary bow cover and sling apparatus illustrated in FIG. 1.
Figure 5:
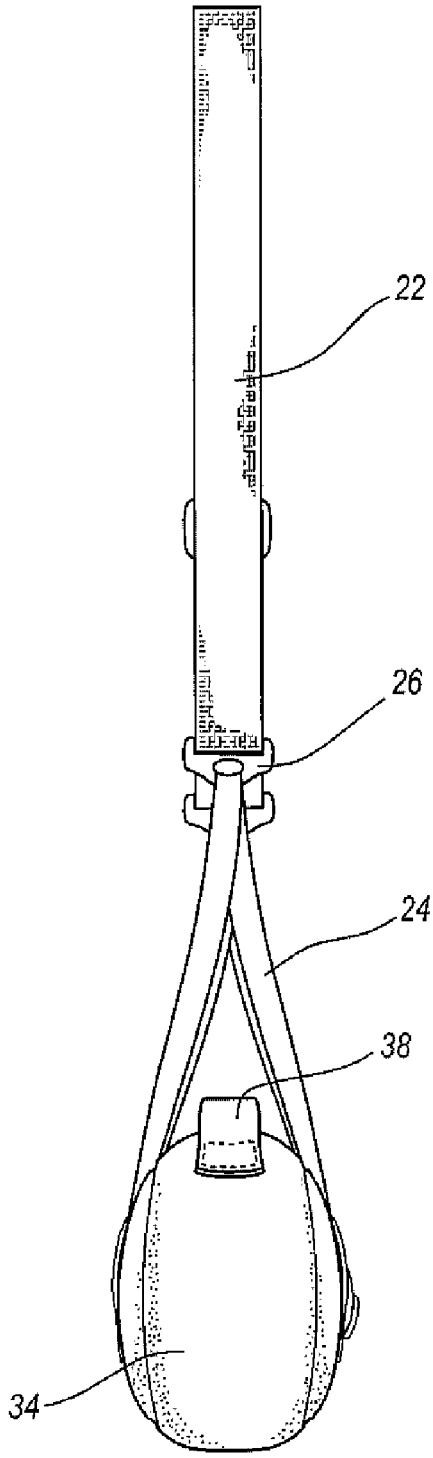
FIG. 5 is an end view of the exemplary bow cover and sling apparatus illustrated in FIG. 1.
Figure 6:
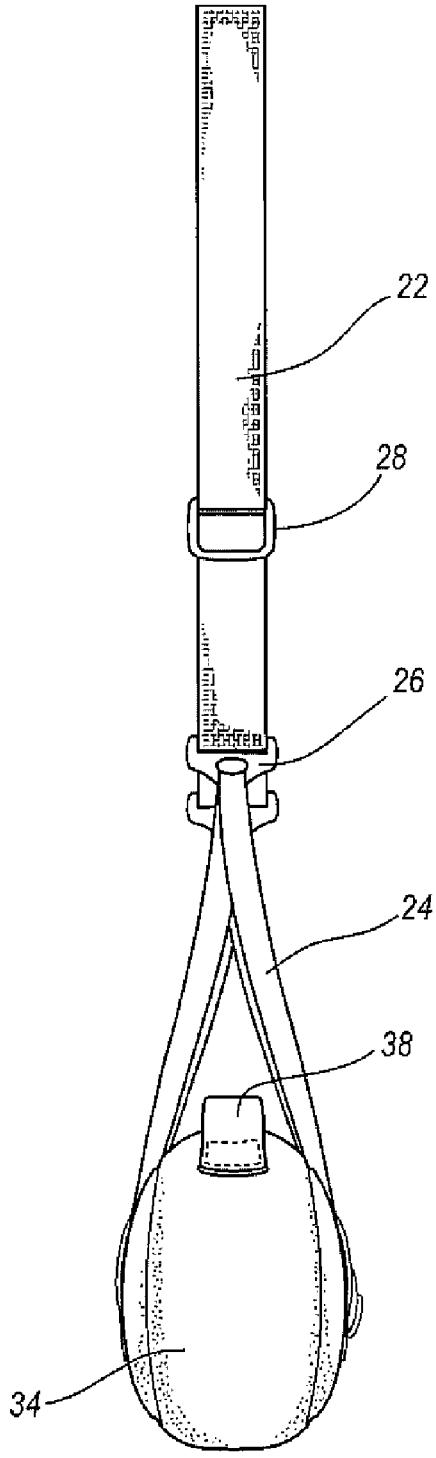
FIG. 6 is an additional end view of the exemplary bow cover and sling apparatus illustrated in FIG. 1.

As seen in FIGS. 2-4, cover structure 30 may also comprise at least one bow retention assembly 40. Bow retention assembly 40 generally represents any type of structure or assembly for retaining at least a portion of an archery bow, such as archery bow 100, within cover structure 30. For example, as illustrated in FIGS. 2-3, bow retention assembly 40 may be configured to retain ends 130 of exemplary archery bow 100 within cam enclosing portions 34. Bow retention assembly 40 may also comprise any number of elements or materials and may be formed in any number of shapes and sizes. For example, as illustrated in FIGS. 2-4, bow retention assembly 40 may comprise an anchor structure 42 and a cord 44 comprising a fixed end 46 and a looped end 48. Anchor structure 42 generally represents any type or form of structure for anchoring the looped end 48 of cord 44 and may be formed in any number of shapes and sizes. For example, anchor structure 42 may comprise a shaft with an enlarged head, as shown in FIGS. 1-4. Similarly, cord 44 may be formed of any length or type material; including, for example, rubber or other suitable elastomers.

In at least one embodiment, bow retention assembly 40 may be positioned proximate end enclosing portion 34. In particular, as seen in FIGS. 2-4, anchor structure 42 may be affixed to a first side of end enclosing portion 34 and the fixed end 46 of cord 44 may be affixed to a second opposing side of end enclosing portion 34. After a portion of an archery bow is positioned within cover structure 30 (e.g., after ends 130 of exemplary archery bow 100 are positioned within end enclosing portions 34 of cover structure 34), the looped end 48 of cord 44 may then be disposed around at least a portion of exemplary bow 100 (e.g., arm 120) and removably secured to anchor structure 42. In many embodiments, cord 44 may comprise an elastomeric material such that, when cord 44 is stretched around limb 120 of exemplary archery bow 100 and secured to anchor structure 42, the elastic bias of cord 44 may help secure cover structure 30 to exemplary bow 100. As shown in FIG. 4, bow retention assembly 40 may also comprise a tab 49 affixed to cord 44 to provide a convenient and easily graspable structure for a user to grasp and pull when manipulating cord 44 about exemplary bow apparatus 100 and anchor structure 42.

In certain embodiments, bow retention assembly 40 may be particularly useful in securing cover structure 30 to an archery bow (such as exemplary archery bow 100) having substantially parallel arms. For example, as seen in FIGS. 2-4, because cord 44 of bow retention assembly 40 may be wrapped around limb 120 of bow 100 and secured to anchor structure 42, bow retention assembly 40 may prevent cover structure 30 from slipping or sliding off of the substantially parallel arms 120 and ends 130 of exemplary archery bow 100. Thus, bow retention assembly 40 may provide a simple, cost effective, and reliable manner for securing cover structure 30 to an archery bow (such as exemplary archery bow 100) having substantially parallel arms. Additionally or alternatively, bow retention assembly 40 may help further secure cover structure 30 to an archery bow having limbs that are in a more vertical alignment with the handle riser.

As seen in FIGS. 2-6, the exemplary strap assembly 20 affixed to cover structure 30 may comprise a primary strap 22 and a secondary strap 24 attached to each end of primary strap 22. In at least one embodiment, secondary straps 24 may be attached to primary strap 22 by a connecting structure 26. Strap assembly 20 may also comprise a strap adjustment structure 28 that enables a user of cover and sling apparatus 10 to adjust the length of strap assembly 20. In certain embodiments, secondary strap 24 may be wrapped around and affixed to at least a portion of cam enclosing portion 34. For example, as seen in FIG. 3, secondary strap 24 may comprise a fixed end attached to the front of cam enclosing portion 34 and a looped end that is wrapped around cam enclosing portion 34 and secured to primary strap 22 by connecting structure 26. Secondary strap 24 may also be retained in a desired position by a strap retention member 25 affixed to both string enclosing portion 32 and cam enclosing portion 34. For example, a portion of secondary strap 24 may be disposed between strap retention member 25 and cam enclosing portion 34 to retain secondary strap 24 in a desired position.

The preceding description has been provided to enable others skilled in the art to best utilize various aspects of the exemplary embodiments described herein. This exemplary description is not intended to be exhaustive or to be limited to any precise form disclosed. Many modifications and variations are possible without departing from the spirit and scope of the instant disclosure. For example, bow retention assembly 40 may comprise any size, shape, or type of fastener assembly. Examples of alternative bow retention assemblies 40 include, without limitation, so-called snap-fit fastener assemblies, hook-and-loop fastener assemblies, button-type fastener assemblies, clasp-type fastener assemblies, toggle-type fastener assemblies, or the like. In addition, as discussed briefly above, exemplary cover and sling apparatus 10 may be adapted for use in connection with any type or form of archery bow, including modern compound archery bows having substantially parallel arms and compound archery bows having arms that are in substantial vertical alignment with the handle riser.

It is desired that the embodiments described herein be considered in all respects illustrative and not restrictive and that reference be made to the appended claims and their equivalents for determining the scope of the instant disclosure. For ease of use, the words "including" and "having," as used in the specification and claims, are interchangeable with and have the same meaning as the word "comprising."

What is claimed is:

1. An archery bow cover and sling apparatus, comprising:

a cover structure comprising a string enclosing portion, a first end enclosing portion provided on a first end of the string enclosing portion, and a second end enclosing portion provided on a second opposing end of the string enclosing portion;

a strap assembly attached to the cover structure;

a first bow retention assembly provided proximate the first end enclosing portion;

wherein the first bow retention assembly is configured to retain at least a portion of an archery bow within the first end enclosing portion;

a second bow retention assembly provided proximate the second end enclosing portion and configured to retain at least a portion of the archery bow within the second end enclosing portion;

wherein the first and second bow retention assemblies each comprise an elastomeric cord and an anchor structure, the elastomeric cord having a fixed end and a looped end, the anchor structure having a shaft with an enlarged head, and the looped end being releasably mounted to the anchor structure to secure the first end enclosing portion about a portion of the archery bow.

2. The archery bow cover and sling apparatus of claim 1, wherein the string enclosing portion comprises an elastomeric member configured to create elastic tension between the first end enclosing portion and the second end enclosing portion.

3. The archery bow cover and sling apparatus of claim 1, wherein the string enclosing portion comprises at least one fastener assembly configured to removably secure the string enclosing portion around at least a bowstring of the archery bow.

4. The archery bow cover and sling apparatus of claim 3, wherein the at least one fastener assembly comprises a female snap-fit button and a male snap-fit button configured to removably snap fit into the female snap-fit button.

5. The archery bow cover and sling apparatus of claim 1, wherein the strap assembly comprises a primary strap and at least one secondary strap wrapped around and affixed to at least a portion of the first end enclosing portion.

6. The archery bow cover and sling apparatus of claim 5, further comprising at least one strap retention member configured to retain the at least one secondary strap in a preferred position.

7. The archery bow cover and sling apparatus of claim 1, further comprising at least one tab provided proximate the first end enclosing portion.

8. A method of manufacturing an archery bow cover and sling apparatus, comprising:

providing a cover structure comprising a string enclosing portion, a first end enclosing portion, and a second end enclosing portion;

attaching a strap assembly to the cover structure;

attaching a first bow retention assembly proximate the first end enclosing portion, the first bow retention assembly configured to retain at least a portion of an archery bow within the first end enclosing portion, attaching a second bow retention assembly proximate the second end enclosing portion, the second bow retention assembly configured to retain at least a portion of the archery bow within the second end enclosing portion, and wherein the first and second bow retention assemblies each comprise an elastomeric cord and an anchor structure, the elastomeric cord having a fixed end and a looped end, the anchor structure having a shaft with an enlarged head, and the looped end being releasably mounted to the anchor structure to secure the first end enclosing portion about a portion of the archery bow.

9. The method of claim 8, further comprising attaching at least one fastener assembly to the string enclosing portion, the at least one fastener assembly configured to removably secure the string enclosing portion around at least a bowstring of the archery bow.

10. A cover and sling apparatus for an archery bow having substantially parallel limbs, the cover and sling apparatus comprising:

a cover structure comprising a string enclosing portion, a first end enclosing portion provided on a first end of the string enclosing portion, and a second end enclosing portion provided on a second opposing end of the string enclosing portion;

a strap assembly attached to the cover structure, the strap assembly comprising a primary strap and at least one secondary strap wrapped around and affixed to at least a portion of the first end enclosing portion;

a first anchor structure having a shaft with an enlarged head affixed to a first side of the first end enclosing portion;

a first elastomeric cord affixed to a second opposing side of the first end enclosing portion and having a looped end configured to be removably secured to the anchor structure; a second anchor structure having a shaft with an enlarged head affixed to a first side of the second end enclosing portion; a second elastomeric cord affixed to a second opposing side of the second end enclosing portion and having a looped end configured to be removably secured to the anchor structure;

wherein each first and second elastomeric cord is configured to wrap around at least a portion of the archery bow to retain the archery bow within each respective first or second end enclosing portion, and wherein each first and second elastomeric cord comprises a tab that provides a graspable structure to grasp when wrapping the elastomeric cord around a portion of the archery bow.

* * * * *